United States Patent [19]

Lind

[11] Patent Number: 5,013,879

[45] Date of Patent: May 7, 1991

[54] MECHANISM FOR FEEDING TRANSVERSE REINFORCEMENT ROD TO A WELDING MACHINE

[75] Inventor: Torvald Lind, Kumla, Sweden

[73] Assignee: Ytong AG, Fed. Rep. of Germany

[21] Appl. No.: 354,401

[22] PCT Filed: Dec. 22, 1987

[86] PCT No.: PCT/EP87/00816

§ 371 Date: Dec. 1, 1988

§ 102(e) Date: Dec. 1, 1988

[87] PCT Pub. No.: WO88/04590

PCT Pub. Date: Jun. 30, 1988

[30] Foreign Application Priority Data

Dec. 22, 1986 [SE] Sweden ..... 8605526-6

[51] Int. Cl.[5] ..... B23K 11/00

[52] U.S. Cl. ..... 219/56; 219/87

[58] Field of Search ..... 219/56, 56.22, 87

[56] References Cited

U.S. PATENT DOCUMENTS 3,497,659 2/1970 Ritter et al. ..... 219/56

4,748,309 5/1988 Ritter et al. ..... 219/56

*Primary Examiner*—Clifford C. Shaw

*Attorney, Agent, or Firm*—Jones, Askew & Lunsford

[57] ABSTRACT

A welding machine comprising a pair of tongs consisting of two electrodes (4',4", and adapted to spot-weld a longitudinal reinforcement rod (1) to a transversal reinforcement cross pin (2), while forming a mesh, at least one type of cross pin (2") having an attachment plate (3) tangentially arranged thereon. Between the welding tongs (4) and one or more magazines (15,20) containing cross pins (2',2"), a carrier (7) reciprocates which comprises an upwardly opening seat (13) adapted to receive a lying cross pin, and a stop member (14) serving, when the carrier reaches an end position where the cross pin is turned over to the welding tongs, to retain the attachment plate (3) in a repeatable, predetermined weld rotation position.

6 Claims, 2 Drawing Sheets

MECHANISM FOR FEEDING TRANSVERSE REINFORCEMENT ROD TO A WELDING MACHINE

TECHNICAL FIELD OF THE INVENTION

The invention relates to an arrangement in welding machines of the type comprising at least one welding electrode member which serves as tongs and is adapted to spot-weld a longitudinal reinforcement wire or rod to a transversal reinforcement wire or across pin, while forming a mesh, at least one type of cross pin having an attachment plate preferably tangentially arranged thereon.

BACKGROUND OF THE INVENTION

In most large lightweight concrete elements, use is made of a reinforcement in the form of a bent welded mesh or so-called cage. Such cages are manufactured in that a number of longitudinal reinforcement steel wires are welded to transversal wires or pins in a welding machine for this particular purpose, while forming a planar mesh which is then bent so as to fit in the lightweight concrete element. Each cage is adapted to or fixed in the mould prior to or in direct connection with the casting of the fresh concrete which forms the lightweight concrete. The cage is suspended in the mould by means of a holding means comprising a number of vertical needles which are connected with a corresponding number of metal plates provided with holes and serving as attachment members, said plates being arranged on some of the cross pins included in the mesh or cage depending on the length of the lightweight concrete element, the number of attachment plates varies, and they may occur on, e.g., every five to ten cross pins of the mesh.

Conventional type welding machines usually comprise magazines which allow the cross pins to fall or roll down to the longitudinal rods, the cross pins being retained in the desired positions by means of magnets or the like until secured by the welding tongs. Such machines involve considerable difficulties in supplying plate-carrying cross pins, since the plates must be oriented in a certain direction and cannot be allowed to swing. From considerations of space, it has, in actual practice, further been impossible to install twin magazines for different types of cross pins, i.e. naked pins and plate-carrying pins. As a rule, this problem has been solved in that the plate-carrying cross pins are welded manually in a separate operation. An alternative solution is to fix the pins in a welding fixture which is then advanced through the welding machine, but in this case, the freedom of choosing the number of pins is restricted.

BRIEF DESCRIPTION OF THE INVENTIVE IDEA

The object of the present invention is to eliminate the above-mentioned problems and to provide, by simple means, an arrangement which in a reliable manner secures exact positioning of the plate-carrying cross pins such that they can be welded in the same operation as the naked cross pins. These and other objects are achieved by means of the characteristic features of the present invention in that between the welding tongs and one or more magazines containing cross pins, a carrier reciprocates which comprises an upwardly opening seat adapted to receive a lying cross pin from the overlying magazine and, adjacent to said seat, a stop member adapted, when the carrier reaches an end position where the cross pin is turned over to the welding tongs, to retain the attachment plate in a repeatable predetermined weld rotation position, in horizontal direction.

In a preferred embodiment, the carrier consists of a connecting rod included in a connecting-rod mechanism, one end of said connecting rod being connected with a wheel included in the mechanism via a hinge spaced from the center of rotation of said wheel, and the opposite end being provided with .said seat and engaging a support positioned between the connecting-rod wheel and the welding tongs, the connecting rod being adapted to receive a cross pin from the magazine in a first end position where said hinge during rotation of the connecting-rod wheel is substantially most remote from the welding tongs, and to transfer said cross pin to the welding tongs in a diametrically opposed second end position after half a turn of said wheel, and during continued rotation of the wheel from said second end position to said first end position, the connecting-rod free end provided with the seat making a dropping or falling movement during which the cross pin secured by the welding tongs is disengaged from the seat.

BRIEF DESCRIPTION OF THE ACCOMPANYING DRAWINGS

In the drawings:

FIG. 1 is a schematic lateral view of the inventive arrangement in a starting position where a naked cross pin is discharged, FIGS. 2–4 are lateral views illustrating three different subsequent steps of operation for transferring said cross pin to the tongs or electrode of the welding machine, and FIGS. 5 and 6 are similar lateral views showing the discharge and transfer of the plate-carrying cross pins to the welding tongs.

DETAILED DESCRIPTION OF A PREFERRED EMBODIMENT OF THE INVENTION

Figure 1:
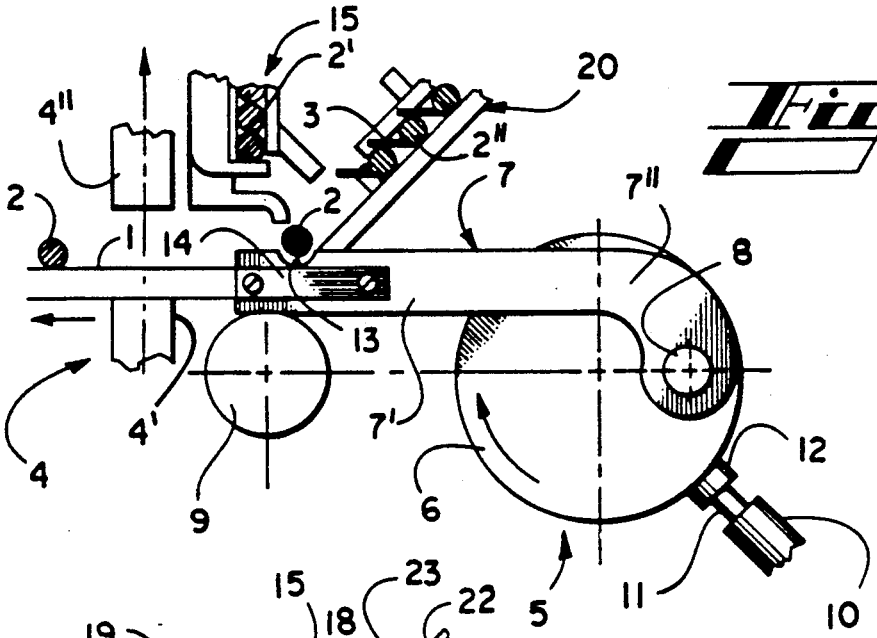

In the drawings, 1 designates a longitudinal reinforcement wire or rod which together with a number of analogous longitudinal rods are to be welded to transversal wires of pins 2 while forming a mesh which is later bent to a cage-like configuration. There are two different types of cross pins, viz. naked pins 2' and pins 2'' provided with attachment plates 3 which have been welded in advance to the outside of the cross pins and extend substantially tangentially therefrom.

4 generally designates a spot welding means comprising two electrodes 4' and 4'' of which the lower 4' is fixedly mounted, while the upper is movable down to and up from the lower. The electrodes 4', 4'' also function as tongs which can pinch the cross pin before power is turned on. In practice, the means 4 is therefore also termed welding tongs.

Although merely one pair of electrodes 4', 4'' is shown in the drawings, the welding tongs 4 comprises, of course, a number of pairs of electrodes which equals the amount of longitudinal rods 1 included in the mesh to be formed.

A connecting-rod mechanism designated 5 comprises a rotatable wheel 6 and a connecting rod 7 connected with the wheel by a hinge 8 located at a certain radial distance from the centre of rotation of the wheel 6. In the area of the free end of the connecting rod 7, the connecting rod rests on a support 9 which in practice preferably is a freely rotating wheel. A braking member 10 cooperates with the wheel 6 and is, in the embodiment shown, imagined to be a compression cylinder whose piston rod 11 is provided with a block 12 slightly abutting against the circumference of the wheel 6, while providing a controlled movement of rotation of the wheel 6 which may have an optimal drive, e.g. a compressed-air source or an electric motor.

In the area of the free end of the connecting rod 7, a recess 13 serving as a seat for the cross pins 2 is formed, which is semi-circular in cross-section. As will appear from the Figures, this seat 13 is formed in the upper side of the connecting rod and opens upwardly. On one side of the connecting rod 7, a guide 14 is further arranged to serve as a stop member against which each attachment plate 3 of the cross pins 2'' can abut and be retained in a determined, in practice horizontal position. It is also to be noted that the upper edge of the guide 14 is disposed on a level with the bottom of the seat 13 which, in turn, is on a level with the upper side of the longitudinal rods 1. Moreover, it is to be noted that at its hinge end, the connecting rod 7 is provided with a projection 7'' extending at an angle with its main portion 7'. The length of the projection 7'' is chosen such that the main portion 7', when resting against the support wheel 9 and being in one of its two opposite end positions, takes a substantially horizontal position.

Although merely one connecting rod 7 is shown in the drawings, it is understood that the arrangement comprises at least two separate analogous connecting rods which can be arranged either on a common wheel or on separate, synchronously driven wheels, while providing at least two points of support for the cross pin.

The naked cross pins 2' are stored in a first magazine 15 having the form of a vertical shaft with a discharge opening 16 defined by a lower lug 17 and an upper, in this case inclined projection 18. A pivotal, preferably spring-loaded retaining finger 19 serves as retaining means for retaining overlying cross pins and also as ejection means for ejecting each cross pin which is dropped on the lug 17.

The plate-carrying cross pins 2'' are stored in a second magazine 20 comprising two mutually movable slides 21,22 of which the upper 22 has an abutment 23 adapted to cooperate with the projection 18 disposed on the first magazine 15 and serving as stopping means. The function of the magazine 20 will be described in detail below with reference to FIGS. 5 and 6.

Function and advantages of the arrangement according to the invention

Figure 2:
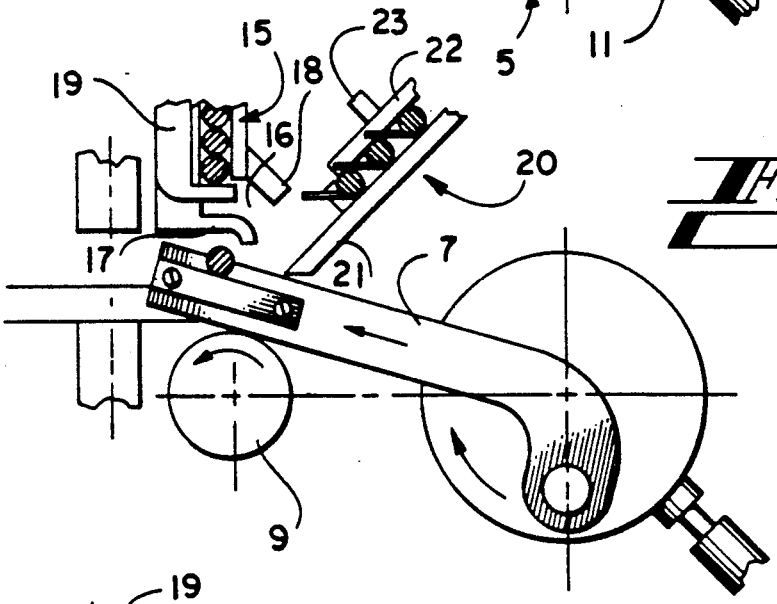
Figure 3:
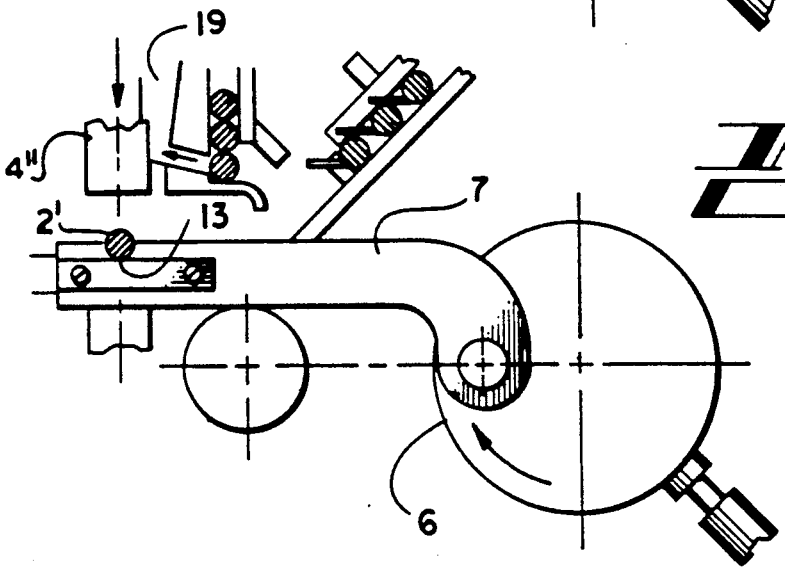
Figure 4:
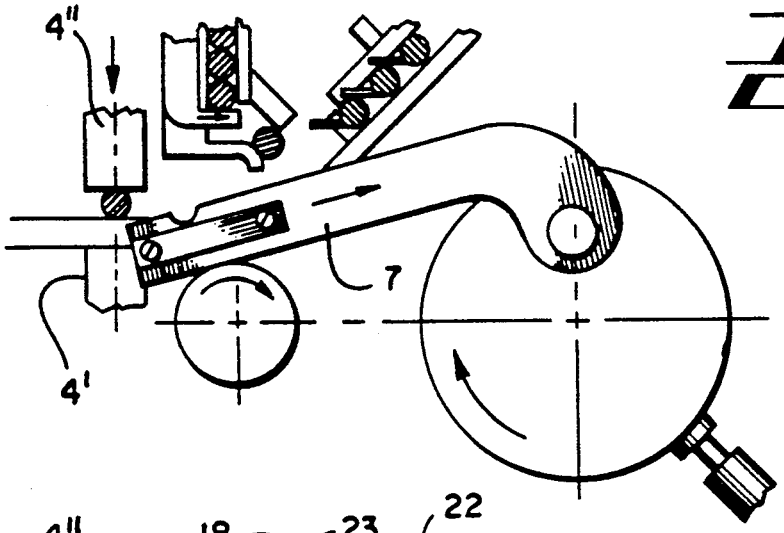

FIG. 1 shows the connecting rod 7 in a first end position in which the hinge 8 is most remote from the welding tongs 4. In this position, the seat 13 is in a retracted position in which it can receive a naked cross pin 2' which has been discharged from the magazine 19 and has fallen down in the opening defined by the lug 17 and the slide 21. During continued rotation in clockwise direction as shown by the arrow, the connecting rod 7 is moved to the left and is, because of its abutment against the support wheel 9, swung to an inclined position in which the cross pin 2' received in the seat 13 is lifted off from the longitudinal rods (as shown in FIG. 2) and conveyed in a curved path to a second end position (shown in FIG. 3) in which the wheel 6 rotates half a turn from the starting position shown in FIG. 1. In this second end position as shown in FIG. 3, the connecting rod 7 is once again in a horizontal position in which the bottom of the seat 13 is on a level with the upper side of the longitudinal rods 1. In precisely this moment, the thus delivered cross pin 2' can be pinched in that the electrode 4'' is lowered towards the cross pin in the direction of the arrow in FIG. 3 (at this stage, the discharge of a further cross pin from the magazine 15 can start by swinging back the retaining finger 19 to a position in which a single pin is ejected to the position shown in FIG. 4 . When the connecting-rod wheel 6 continues to rotate from the end position in FIG. 3 back to the first end position, the free end of the connecting 7 makes a dropping or falling movement during which the cross pin 2' now retained by the welding tongs 4 disengages, without resistance, from the seat 13. Subsequently, the connecting rod returns to its first end position whereupon the work cycle as described is repeated. As illustrated in FIG. 4, current can be supplied to the electrodes 4',4'' after the connecting rod is out of touch with the cross pin 2'. It should also be noted that a cross pin discharged from the magazine 15 cannot leave the opening defined by the lug 17 and the slide 21 until the seat 13 has returned to its end position (shown in FIG. 1), where the seat is located immediately under said opening.

Figure 5:
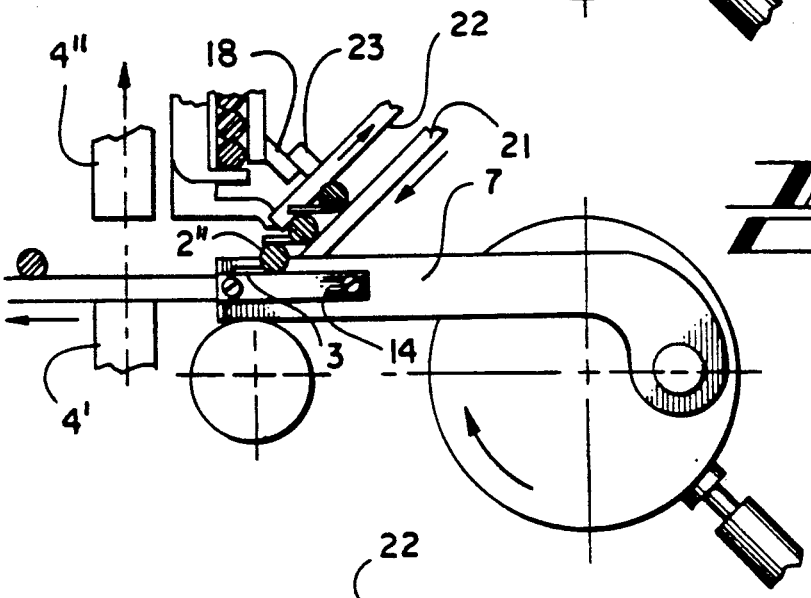
Figure 6:
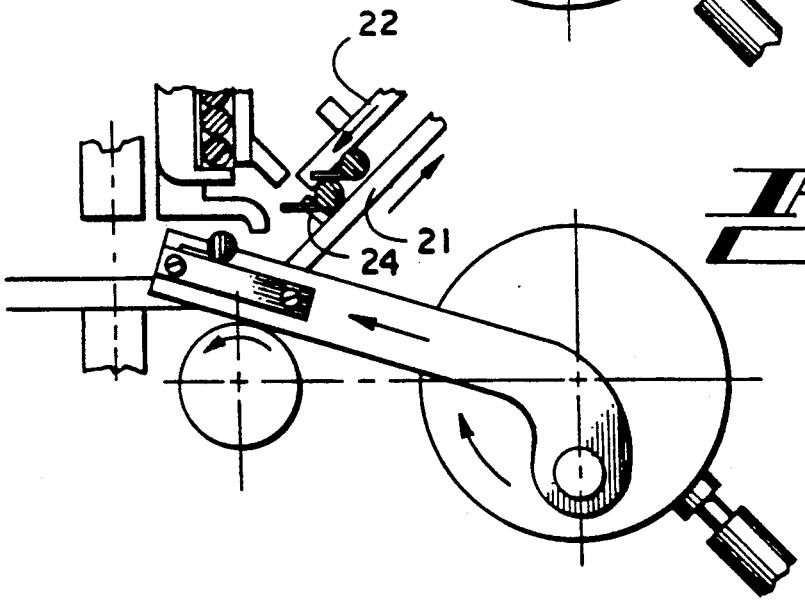

Reference is now made to FIGS. 5 and 6 in which a plate-carrying cross pin 2'' is transferred from the magazine 20 to the welding tongs 4. In a first step, the two slides 21,22 are jointly moved downwardly towards the connecting rod 7. The lower slide 21 alone continues after the upper slide 22 has been stopped when the abutment 23 abuts the stopping means 18, whereupon the lower cross pin 2'' is deposited in the seat 13. Immediately after that, the motional direction of the lower slide 21 is reversed, a carrier pin 24 providing that the remaining cross pins in the magazine are moved back to a starting position in which the discharge cycle can be repeated.

When the cross pin 2'' is received by the seat 13, the associated attachment plate engages with the upper side of the guide 14 and is kept in a determined weld rotation position, viz. horizontally, when the connecting rod reaches the welding tongs in its second end position (shown in FIG. 3). In other words, the plate-carrying cross pin takes, without any magnets etc whatsoever, a predetermined position which is repeatable to all cross pins when pinched by the welding tongs.

It should be observed that the connecting-rod wheel 6 can be driven either continuously at a relatively low rate of rotation or intermittently with short stops at least in the second end position. Further, the advantage should be noted that the velocity of the connecting rod 7 reaches its maximum when transported between the two end positions, whereas the movements of the connecting rod adjacent the respective end position are comparatively light. In other words, the arrangement operates rapidly during the actual advance of the individual cross pin, but in a favourably slow manner when receiving and giving away the cross pin.

Conceivable modifications of the invention

Of course, the invention is not limited to the embodiment described above and shown in the drawings. Thus, it is theoretically possible, to use as a carrier, a reciprocating slide provided with a seat and a stop member for the attachment plate, instead of a connecting rod, although in practice the connecting-rod mechanism as described is preferred. Instead of precisely a guide 14 of the described type, it is further possible to use other optimal stop members to determine the position of the attachment plate 3 in the manner described. Also the seat may have a shape other than precisely a recess in the carrier. The seat may, for example, be defined by optional separate projections.

I claim:

1. A feeding mechanism for feeding transversal reinforcement rods (2) of two different types (2', 2'') to a welding machine comprising a set of welding electrodes (4', 4'') arranged in pairs and operative to spot-weld said transversal reinforcement rods to a number of longitudinal reinforcement rods (1) while forming a reinforcement netting, at least one type (2'') of said transversal reinforcement rods having an attachment plate (3) projecting tangentially therefrom, said feeding mechanism comprising:

at least one rotatable wheel (6) disposed in the area below two magazines (15, 20) for storing and dispensing said transversal reinforcement rods (2', 2'');

a crank arm (7) connected to said wheel (6) by a hinge (8) located at a certain radial distance from the center of revolution of said wheel;

support means (9) disposed between said wheel (6) and said set of welding electrodes (4', 4'') to support said crank arm at a point spaced apart from said wheel;

an upwardly opening seat (13) in said crank arm (7) for receiving an individual transversal reinforcement rod (2', 2'') from one of said magazines (15, 20); and a stop member (14) on said crank arm (7) for retaining said attachment plate (3) of an associated rod (2,2') in a repeatable, predetermined welding position when the crank arm (7) is transferred from an initial position in which said seat (13) is positioned below said magazine, to a delivering position in which said seat is positioned close to said set of welding electrodes (4',4''), said transfer being effectuated by rotating said wheel (6) half of a revolution.

2. The feeding mechanism as claimed in claim 1, whereby in the initial position said hinge (8) during rotation of said wheel (6) is substantially most remote from the welding electrodes (4',4'') which serve as tongs, and for transferring said transversal reinforcement rod to the welding tongs in the diametrically opposed delivery position after half of a revolution of said wheel the free and offset crank arm (7) provided with said seat undergoes, during the continued revolution of said wheel from said delivery position to said initial position, a downward movement which disengages the transversal reinforcement rod secured by the welding electrode from said seat.

3. The feeding mechanism as claimed in claim 2, whereby the center of revolution of said support means comprises a freely rotating wheel (9) positioned in substantially the same horizontal plane as the center of revolution of said wheel 6, and said crank arm (7) comprises at its hinge end a projection (7'') extending at an angle with the main portion (7') of the crank arm (7) and securing said main portion (7') extending substantially horizontally in said delivery position.

4. The feeding mechanism as claimed in one of the claims 1 to 3, whereby a braking member (10) cooperates with said wheel (6) to apply a low brake pressure to said wheel so as to provide a controlled movement of revolution thereof.

5. The feeding mechanism as claimed in claim 2, whereby said seat has the shape of a semi-circular recess (13) in the upper side of the crank arm, and said stop member (14) is a guide mounted on one side of the crank arm (7).

6. The feeding mechanism as claimed in one of the claims 2 or 3, whereby for said welding electrodes (4',4''), two magazines (15,20) are arranged which open in an area close to one another, the first magazine (15) being vertical and receiving plain transversal reinforcement rods (2') and a second inclined magazine (20) for receiving plate-carrying transversal reinforcement rod (2''), said two magazines mutually defining an opening from which a transversal reinforcement rod can be removed and carried along after being reached by said crank arm (7).

* * * * *